US011207691B2

(12) United States Patent
Wojtowicz

(10) Patent No.: US 11,207,691 B2
(45) Date of Patent: Dec. 28, 2021

(54) THERMAL ISOLATION OF REACTION SITES ON A SUBSTRATE

(71) Applicant: LIFE TECHNOLOGIES CORPORATION, Carlsbad, CA (US)

(72) Inventor: Janusz Wojtowicz, Sunnyvale, CA (US)

(73) Assignee: LIFE TECHNOLOGIES CORPORATION, Carlsbad, CA (US)

( * ) Notice: Subject to any disclaimer, the term of this patent is extended or adjusted under 35 U.S.C. 154(b) by 675 days.

(21) Appl. No.: 15/757,638

(22) PCT Filed: Sep. 2, 2016

(86) PCT No.: PCT/US2016/050258
§ 371 (c)(1),
(2) Date: Mar. 5, 2018

(87) PCT Pub. No.: WO2017/041031
PCT Pub. Date: Mar. 9, 2017

(65) Prior Publication Data

US 2019/0022657 A1 Jan. 24, 2019

Related U.S. Application Data

(60) Provisional application No. 62/214,581, filed on Sep. 4, 2015.

(51) Int. Cl.
*B01L 7/00* (2006.01)

(52) U.S. Cl.
CPC ..... *B01L 7/52* (2013.01); *B01L 2300/0819* (2013.01); *B01L 2300/0829* (2013.01);
(Continued)

(58) Field of Classification Search
CPC ..... B01L 7/52; B01L 2300/0819; B01L 2300/0829; B01L 2300/1805;
(Continued)

(56) References Cited

U.S. PATENT DOCUMENTS

2003/0008286 A1 1/2003 Zou et al.
2003/0008383 A1* 1/2003 Bordenkircher ..... B01L 7/52 435/286.2

(Continued)

FOREIGN PATENT DOCUMENTS

CN 102083956 A 6/2011
CN 102164674 A 8/2011

(Continued)

OTHER PUBLICATIONS

PCT/US2016/050258, "International Search Report dated", Dec. 7, 2016, 3 Pages.

(Continued)

*Primary Examiner* — William H. Beisner
*Assistant Examiner* — Danielle B Henkel
(74) *Attorney, Agent, or Firm* — François A. Pelaez

(57) ABSTRACT

A thermal block assembly is provided. The assembly can comprise a substrate comprising a first surface configured with a plurality of reaction sites each reaction site configured to contain a biological sample and a sample block comprising a plurality of pedestals configured to thermally modulate the plurality of biological samples wherein each pedestal is thermally coupled to one of the reaction sites. The assembly can further comprise cooling blocks, slots and insulating rings associated with reaction sites each capable of minimizing heat flow between reaction sites. A method for thermally isolating reaction sites is also provided. The method can comprise providing a substrate including a plurality of reaction sites, each reaction site configured to contain a biological sample, providing a sample block comprising pedestals, each pedestal having a dimension substantially equal to a dimension of the reaction site and thermally coupled to the reaction site, thermally isolating the reaction sites with a thermal isolating feature, modulating (Continued)

the temperature of the pedestals through a sequence of temperature and hold times and cooling the reaction sites with cooling blocks.

12 Claims, 18 Drawing Sheets

(52) U.S. Cl.
CPC ..... *B01L 2300/1805* (2013.01); *B01L 2300/1883* (2013.01); *B01L 2300/1894* (2013.01)

(58) Field of Classification Search
CPC ..... B01L 2300/1883; B01L 2300/1894; B01L 3/50851; B01L 7/54; B01L 9/523; B01L 230/0819; B01J 19/0093; B01J 2219/00783; B01J 2219/00804; B01J 2219/00819; B01J 2219/00873; B01J 2219/00961; F28F 13/00

See application file for complete search history.

(56) References Cited

U.S. PATENT DOCUMENTS

| | | | |
|---|---|---|---|
| 2006/0104865 | A1 | 5/2006 | Merrit et al. |
| 2006/0166226 | A1 | 7/2006 | Kudoh et al. |
| 2009/0263782 | A1 | 10/2009 | Ward et al. |
| 2010/0203595 | A1 | 8/2010 | Ward et al. |
| 2013/0109021 | A1 | 5/2013 | Hwang |
| 2013/0143272 | A1 | 6/2013 | Guo et al. |
| 2015/0217292 | A1 | 8/2015 | Ng et al. |

FOREIGN PATENT DOCUMENTS

| | | | | |
|---|---|---|---|---|
| EP | 1464401 | | 10/2004 | |
| JP | 2003505663 | A | 2/2003 | |
| JP | 2014518758 | A | 8/2014 | |
| WO | WO-2007142604 | A1 * | 12/2007 | ..... B01L 3/502707 |
| WO | WO-2009157695 | A2 | 12/2009 | |
| WO | WO-2016/091344 | | 6/2016 | |

OTHER PUBLICATIONS

Chinese Third Office Action for Application No. CN201680056544.7, dated Apr. 13, 2021.

* cited by examiner

THERMAL ISOLATION OF REACTION SITES ON A SUBSTRATE

CROSS-REFERENCE TO RELATED APPLICATIONS

This application is a 371 National Stage application of International Application No. PCT/US2016/50258, filed Sep. 2, 2016, which claims priority to U.S. Provisional Application No. 62/214,581, filed Sep. 4, 2015, all of which disclosures are herein incorporated by reference in their entirety.

BACKGROUND

Polymerase Chain Reaction (PCR) is a frequently used tool in genetic analysis to amplify samples of DNA. The process can involve placing biological samples of DNA into or onto a sample holder suitable to isolate each sample from other samples at a reaction site. Such sample holders are well known in the art and can take many forms such as, but not limited to, microtiter plates, microcards, individual tubes, strips of connected tubes, capillaries, micro arrays and slides. Additionally, the number of samples contained in a sample holder can vary depending, for example, on the type of analysis required, and can be from 1 sample to thousands of samples in or on a single sample holder.

One of the challenges encountered with sample holders designed for multiple functions such as, for example, mixing, fluid transfer, heating and cooling is that it can be difficult to thermally manipulate one region of the holder without thermally affecting adjacent regions. This can also be challenging in the case of processing small, closely spaced samples in, for example, polymerase chain reactions (PCR). Amplifying DNA (Deoxyribose Nucleic Acid) using the PCR process, involves cycling a specially constituted liquid reaction mixture through several different temperature incubation periods in a thermal cycler. The reaction mixture is comprised of various components including the DNA to be amplified and at least two primers sufficiently complementary to the sample DNA to be able to create extension products of the DNA being amplified. A key to PCR is the concept of thermal cycling in a thermal cycling instrument. The thermal cycler can be designed to alternating steps of denaturing DNA, annealing short primers to the resulting single strands, and extending those primers to make new copies of double-stranded DNA. In thermal cycling the PCR reaction mixture is repeatedly cycled from high temperatures of around 95° C. for denaturing the DNA, to lower temperatures of approximately 50° C. to 70° C. for primer annealing and extension.

In some previous PCR instruments, sample tubes are inserted into sample wells on a metal block. To perform the PCR process, the temperature of the metal block is cycled according to prescribed temperatures and times specified by the user in a PCR protocol. The cycling is controlled by a computer and associated electronics. As the metal block changes temperature, the samples in the various tubes experience similar temperature changes. Such a heated metal block can be used with any of the sample holders mentioned above. However, when performing PCR on very small samples, for example, the device can be subjected to very demanding thermal protocols not typical in some previous PCR instruments. One such protocol can require one or several samples to be heated to, for example, 95° C. while an adjacent sample or samples needs to be maintained at a temperature substantially different from 95° C. In the case of samples requiring different temperatures the block can heat up not only the desired reaction sites but can also transfer heat to the surrounding area and other samples. This thermal transfer can adversely influence the other samples and negatively affect the amplification or incubation of the samples. It would therefore be desirable to have sample holders and that can be used to conduct, for example, thermal cycling reactions for PCR without thermally affecting adjacent reactions.

SUMMARY

In one embodiment of the present invention, a thermal block assembly is provided. The assembly comprises a substrate comprising a first surface configured with a plurality of reaction sites each reaction site configured to contain a biological sample wherein the substrate is configured with a feature to improve thermal isolation of the reaction sites and a sample block comprising a plurality of pedestals configured to thermally modulate the plurality of biological samples wherein each pedestal is thermally coupled to one of the reaction sites.

In another embodiment, a thermal block assembly is provided. The assembly comprises a substrate comprising a first surface configured with a plurality of reaction sites each reaction site configured to contain a biological sample, a sample block comprising a plurality of pedestals configured in one or more rows, wherein each pedestal is thermally coupled to one of the reaction sites and configured with a feature to improve thermal isolation of the reaction sites and a plurality of cooling blocks, each cooling block associated with one reaction site and capable of minimizing heat flow between reaction sites.

In another embodiment a method for thermally isolating reaction sites is provided. The method comprises the steps of providing a substrate including a plurality of reaction sites, each reaction site configured to contain a biological sample, providing a sample block comprising pedestals, each pedestal having a dimension substantially equal to a dimension of the reaction site and thermally coupled to the reaction site, modulating the temperature of the pedestals through a sequence of temperature and hold times with thermoelectric devices, thermally isolating the reaction sites from each other and cooling the reaction sites with cooling blocks.

Additional aspects, features, and advantages of the present invention are set forth in the following description and claims, particularly when considered in conjunction with the accompanying drawings in which like parts bear like reference numbers.

BRIEF DESCRIPTION OF THE DRAWINGS

For a more complete understanding of the principles disclosed herein, and the advantages thereof, reference is now made to the following descriptions taken in conjunction with the accompanying drawings, in which.

DESCRIPTION OF VARIOUS EMBODIMENTS

Figure 1:
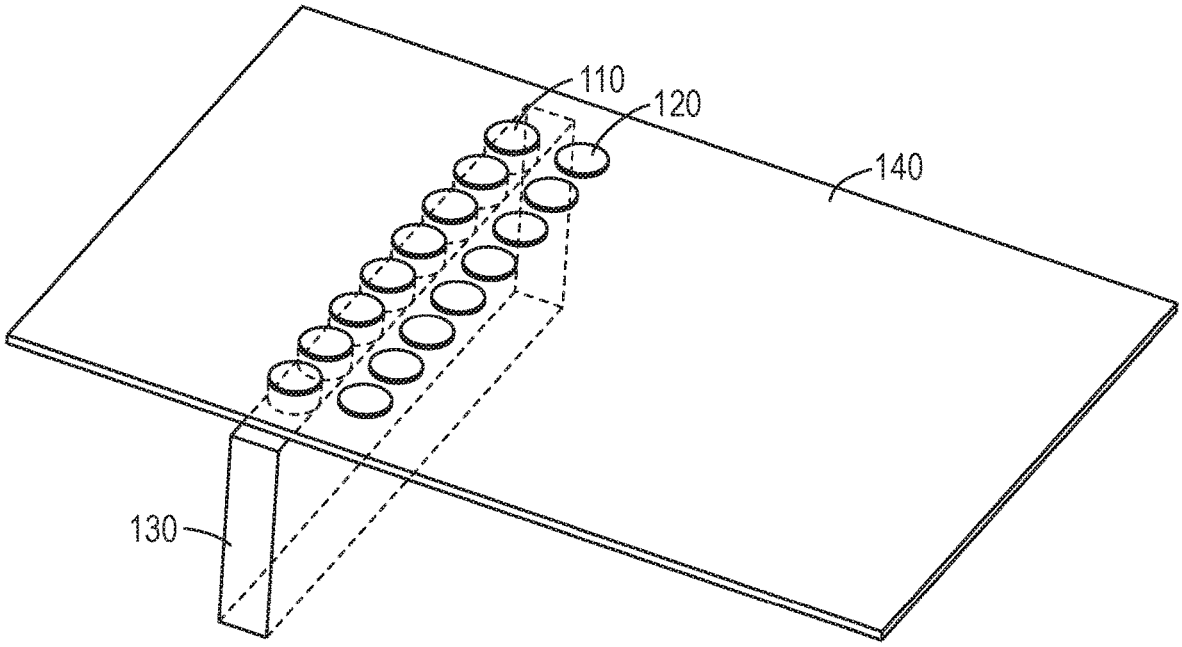
FIG. 1 is a perspective view of a substrate with two rows of reaction sites and their spatial relationship to a sample block.

Embodiments of apparatuses, systems and methods for providing thermal isolation between elements of a substrate are described in this specification. The section headings used herein are for organizational purposes only and are not to be construed as limiting the described subject matter in any way.

Reference will be made in detail to the various aspects of the disclosure, examples of which are illustrated in the accompanying drawings. Wherever possible, the same reference numbers will be used throughout the drawings to refer to the same or like parts.

In this detailed description of the various embodiments, for purposes of explanation, numerous specific details are set forth to provide a thorough understanding of the embodiments disclosed. One skilled in the art will appreciate, however, that these various embodiments may be practiced with or without these specific details. In other instances, structures and devices are shown in block diagram form. Furthermore, one skilled in the art can readily appreciate that the specific sequences in which methods are presented and performed are illustrative and it is contemplated that the sequences can be varied and still remain within the spirit and scope of the various embodiments disclosed herein.

All literature and similar materials cited in this application, including but not limited to, patents, patent applications, articles, books, treatises, and internet web pages are expressly incorporated by reference in their entirety for any purpose. Unless defined otherwise, all technical and scientific terms used herein have the same meaning as is commonly understood by one of ordinary skill in the art to which the various embodiments described herein belongs. When definitions of terms in incorporated references appear to differ from the definitions provided in the present teachings, the definition provided in the present teachings shall control.

It will be appreciated that there is an implied "about" prior to the temperatures, distances, etc. discussed in the present teachings, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting. In this application the term "substrate" is used to refer to all sample holder formats known in the art and is not intended to be limiting to any specific format. Further, it is to be understood that both the foregoing general description and the following detailed description are exemplary and explanatory only and are not restrictive of the present teachings.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may present a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

The present teachings disclose various embodiments of a substrate and sample block having improved thermal isolation throughout the devices. As will be discussed in more detail subsequently, various embodiments of substrates and sample blocks having an improved thermal isolation provide for desired performance of bio-analysis instrumentation utilizing such devices.

In the case of PCR, for example, it can be desirable to change the sample temperature between the required temperatures in the cycle as quickly as possible for several reasons. First the chemical reaction has an optimum temperature for each of its stages and as such less time spent at non-optimum temperatures can mean a better chemical result is achieved. Secondly a minimum time is usually required at any given set point which sets minimum cycle time for each protocol and any time spent in transition between set points adds to this minimum time. Since the number of cycles is usually quite large, this transition time can significantly add to the total time needed to complete the amplification.

The absolute temperature that each reaction site attains during each step of the protocol is critical to the yield of product. It is therefore advantageous to thermally isolate regions of the substrate in order to minimize the influence of one region on another. The geometries that can be found in substrates can frequently be small resulting in hot or warm regions being located very close to cooler regions of the device. This close proximity can result in cooler regions being warmer than intended due to heat flow through the device from the hot or warm region to the cool region thereby compromising the performance of the cooler regions. Additionally the small geometries can make it difficult to thermally isolate the hot and cool regions.

FIG. 1 depicts an embodiment not uncommon in the art. In this embodiment substrate 140 is shown upon which are two rows 110 and 120 of eight reaction sites. Coupled to the underside of substrate 140 is heated block 130 in the shape of a bar under row 110 and opposite the substrate from row 110. Such a relationship between a substrate, reaction sites and heated block is also not uncommon in the art. Heated blocks are also well known in the art and are frequently fabricated of materials with high thermal conductivities. Some examples of suitable materials for heated blocks include, but are not limited to, silver, gold, aluminum, magnesium and copper. In some embodiments a heated block can be fabricated in a rectangular geometry, but can also be circular, square or any other shape suitable for the application. Frequently a surface of the block has an array of depressions capable of receiving a sample containment device sometimes referred to as a plate or tube. Array sizes vary and can be, for example, 8, 16, 24, 48, 96, 384, 1536 or more. In some applications the metal block can include a flat surface without depressions to accommodate an array of reaction sites that may have a flat surface such as, for example, a glass slide.

Figure 2A:
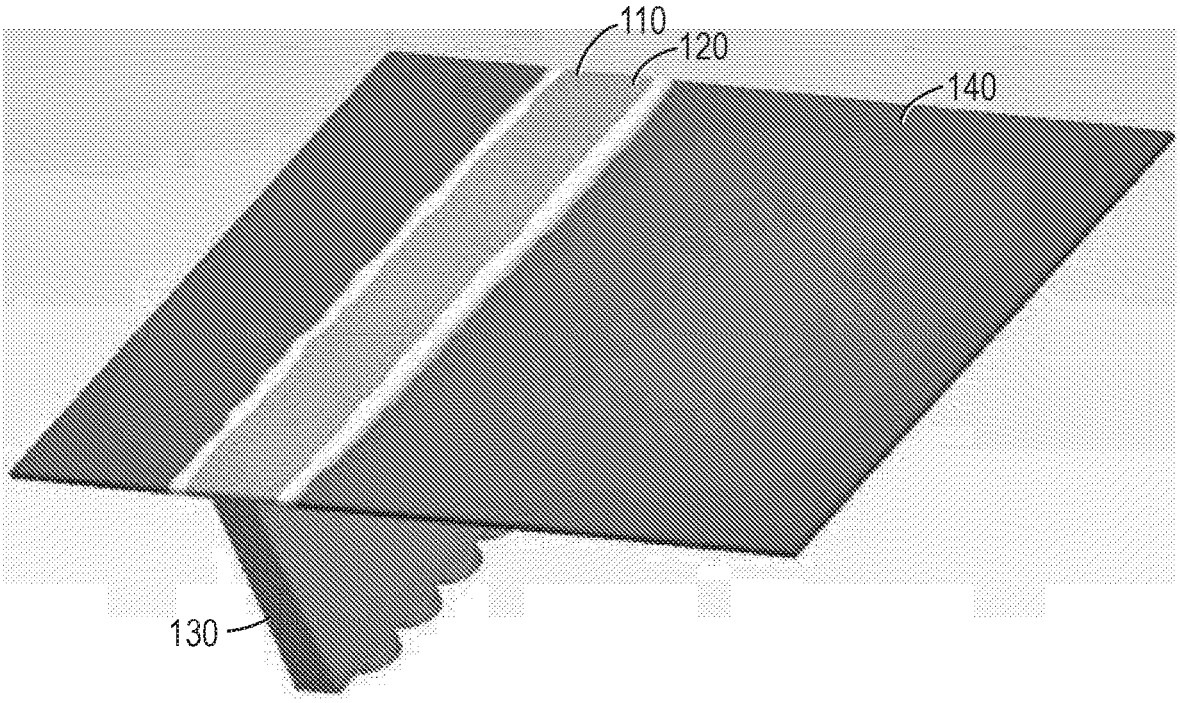
FIG. 2A is a perspective view of a thermally mapped row of reaction sites heated with a single heated block or bar.
Figure 2B:
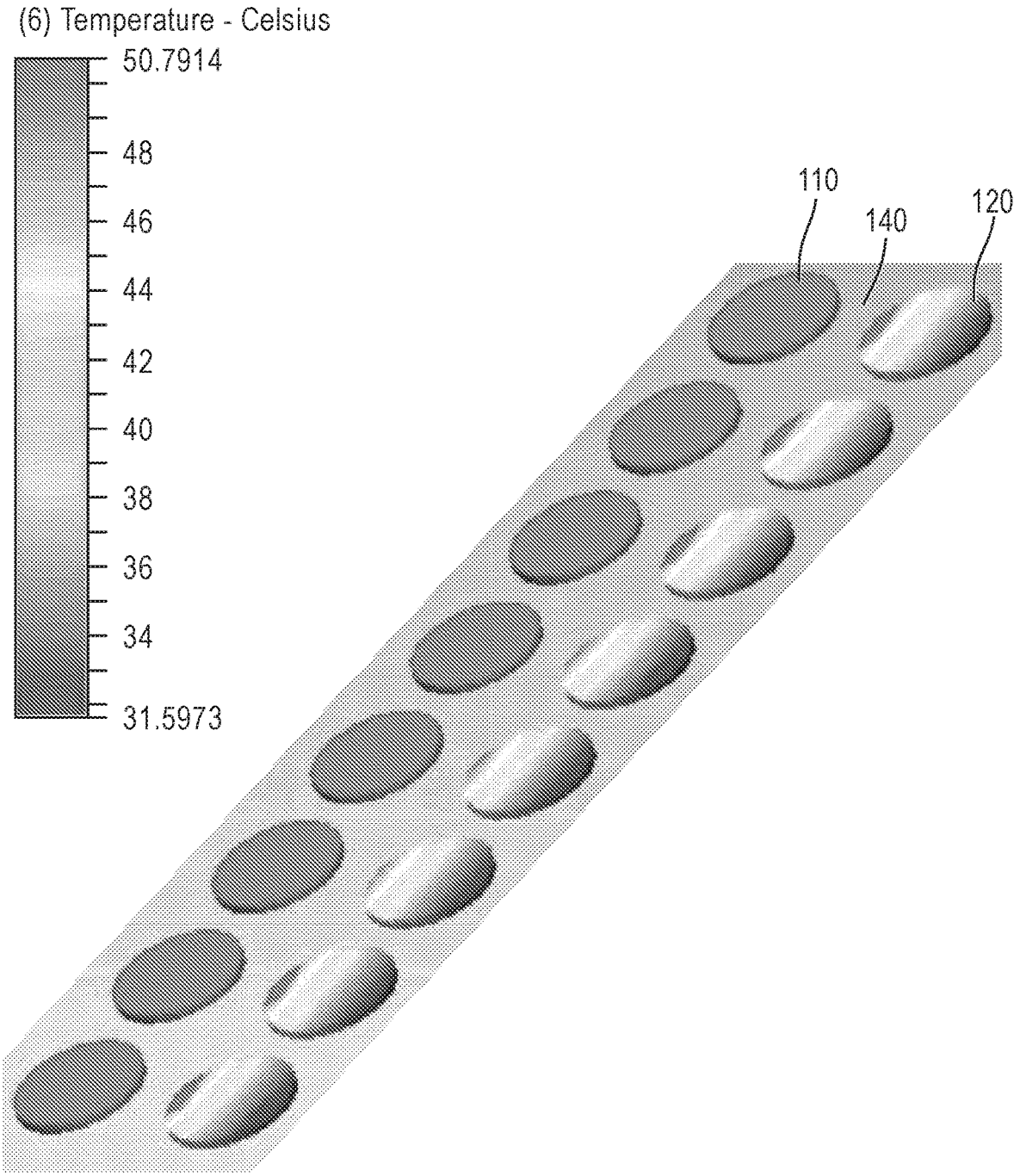
FIG. 2B is a thermal perspective view of a row of heated reaction sites and the thermal effect on an adjacent row.

In this embodiment block 130 was fabricated as a metallic bar with a flat upper surface and dimensioned to thermally couple to the underside of substrate 140 opposite the reaction sites of row 110. Row 120 was kept at room temperature or approximately 27° C. Block 130 was heated to 95° C. and the temperature of rows 110 and 120 were determined. FIG. 2A depicts the thermal results. It is clear from the thermal map that both rows 110 and 120 are heated to approximate the same temperature and the individual reaction sites are not distinguishable. FIG. 2B shows a more detailed interaction between heated row 110 and unheated row 120. Heated row 110 is shown to be a uniform high temperature as indicated by the uniform shading. This temperature provides a high enough temperature difference between rows 110 and 120 that heat flows across and through substrate 140 from row 110 to row 120. The temperature scale included in FIG. 2B indicates the temperature of the region of unheated row 120 closest to heated row 110 is approximately 50° C. Additionally it can also be seen that there is a significant temperature gradient across unheated row 120 of approximately 20° C. These results demonstrate the magnitude of interaction between closely spaced adjacent rows having significantly different temperature requirements. When performing PCR, it can be common to heat one row to 95° C. for as long as 10 minutes, for example, while requiring an adjacent row to be maintained at less than 37° C. To ensure no adverse thermal interaction by a heated row on an unheated adjacent row it would be advantageous to minimize the thermal effect on the adjacent row. The data presented in FIGS. 2A and 2B confirms the thermal interaction between adjacent rows and demonstrates the need for an embodiment that would minimize this effect.

There are many factors that can contribute to thermal interaction between reaction sites. Some of these factors can include, but not be limited to, spacing, reaction site size which can be related to spacing, the temperature difference between the reaction sites and substrate materials. One skilled in the art would understand that one or a combination of factors may be required to achieve the degree of thermal isolation desired. With this understanding, solutions for thermal isolation are presented as follows.

Substrate Materials

Materials used for fabricating substrates can be, for example, elastomers such as, for example, polymers that display rubber-like elasticity. One skilled in the art will further know that there are many types of elastomers, such, for example as saturated rubbers, unsaturated rubbers, thermoplastic elastomers and polysulfide rubber. These materials all exhibit relatively poor thermal conductivity, and as such provide a level of thermal isolation between adjacent rows of reaction sites. As an example, thermally conductive elastomers from CoolPoly® exhibit thermal conductivities of up to 5 W/mK. As a comparison, metals such as Aluminum, Copper, Gold and Silver exhibit thermal conductivities from 205 W/mK to 406 W/mK. However as discussed above, even though they are poor thermal conductors they still conduct heat sufficiently to affect the temperature of reactions in adjacent wells of a substrates.

Substrates can also be fabricated from polymers including, for example, polypropylene, although other polymers could also be used. By way of example, polypropylene has a thermal conductivity on the order of 0.1 W/mK to 0.22 W/mK. This degree of conductivity can still result in reaction sites affecting other reaction sites if the temperature difference between the sites is sufficiently large as presented above.

Thermal Block Geometry

Figure 3A:
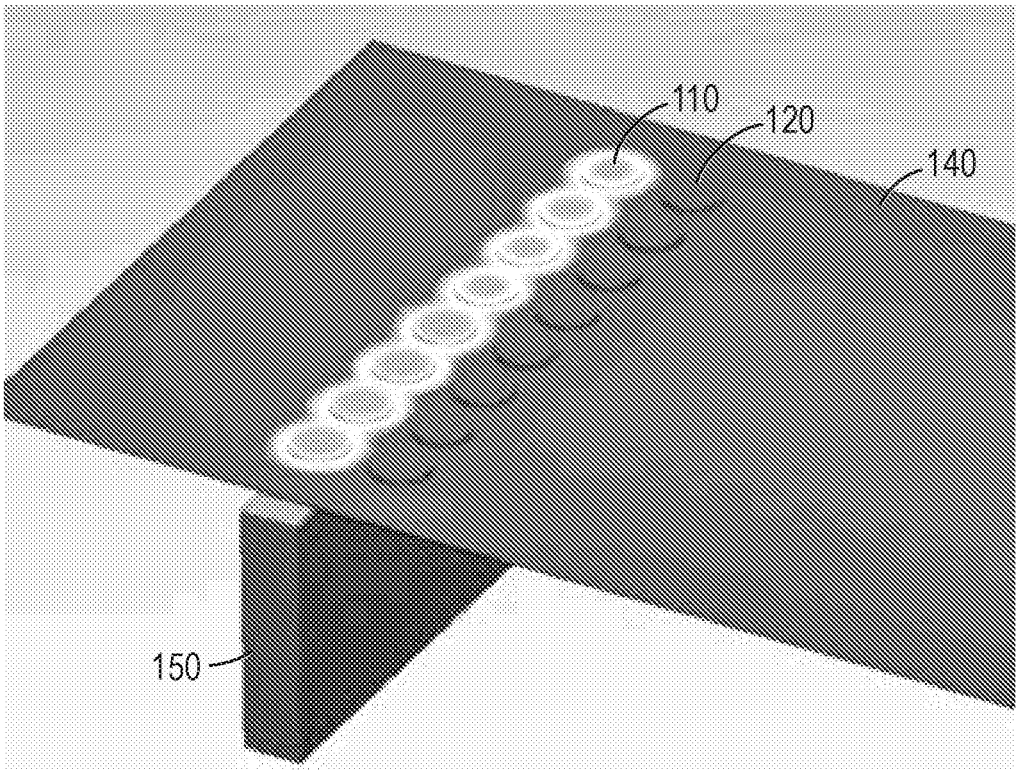
FIG. 3A is a perspective view of a row of reaction sites heated with a thermal block containing pedestals, in accordance with various embodiments.
Figure 4:
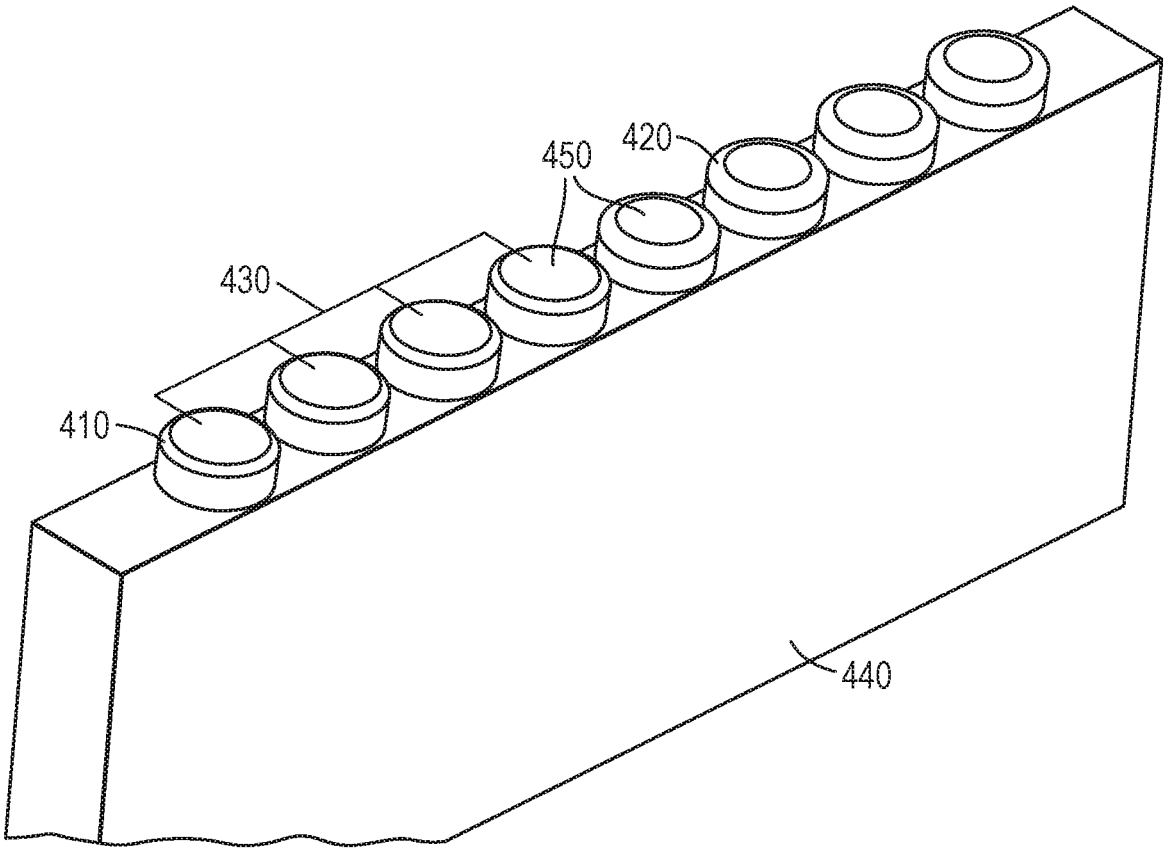
FIG. 4 is a perspective view of a heated block with pedestal and a radius added to each pedestal, in accordance with various embodiments.

It is evident from the thermal map of FIG. 2B that heating sample block 130 to 95° C. provided enough heat to row 110 and substrate 140 to heat at least a portion of row 120 to approximately 50° C. which as presented above would be sufficient to adversely affect the reactions in row 120. FIG. 3A depicts a thermal map which is similar to the thermal map depicted in FIG. 2A. However, in the embodiment represented by FIG. 3A, block 130 of FIG. 2B has been replaced with block 150. Block 150 differs from block 130 in that the flat upper surface of block 130 has been replaced with a series of pedestals. The top surface of each pedestal can have a shape that is substantially circular (as illustrated in FIG. 3A), square, oval, rectangular or any other shape suitable for the application. Additionally, the top surface 450 (as illustrated in FIG. 4) of each pedestal can, for example, have an area that can be substantially equal to the area of the contact surface of a corresponding reaction site, smaller than the area of the contact surface of a corresponding reaction site or larger than the area of the contact surface of a corresponding reaction site. Regardless of shape and size block 150 can be located under substrate 140 with each pedestal surface 450 (as illustrated in FIG. 4) aligning with a region of a substrate surface 620 (as illustrated in FIG. 6B) opposite the reaction site.

Figure 3B:
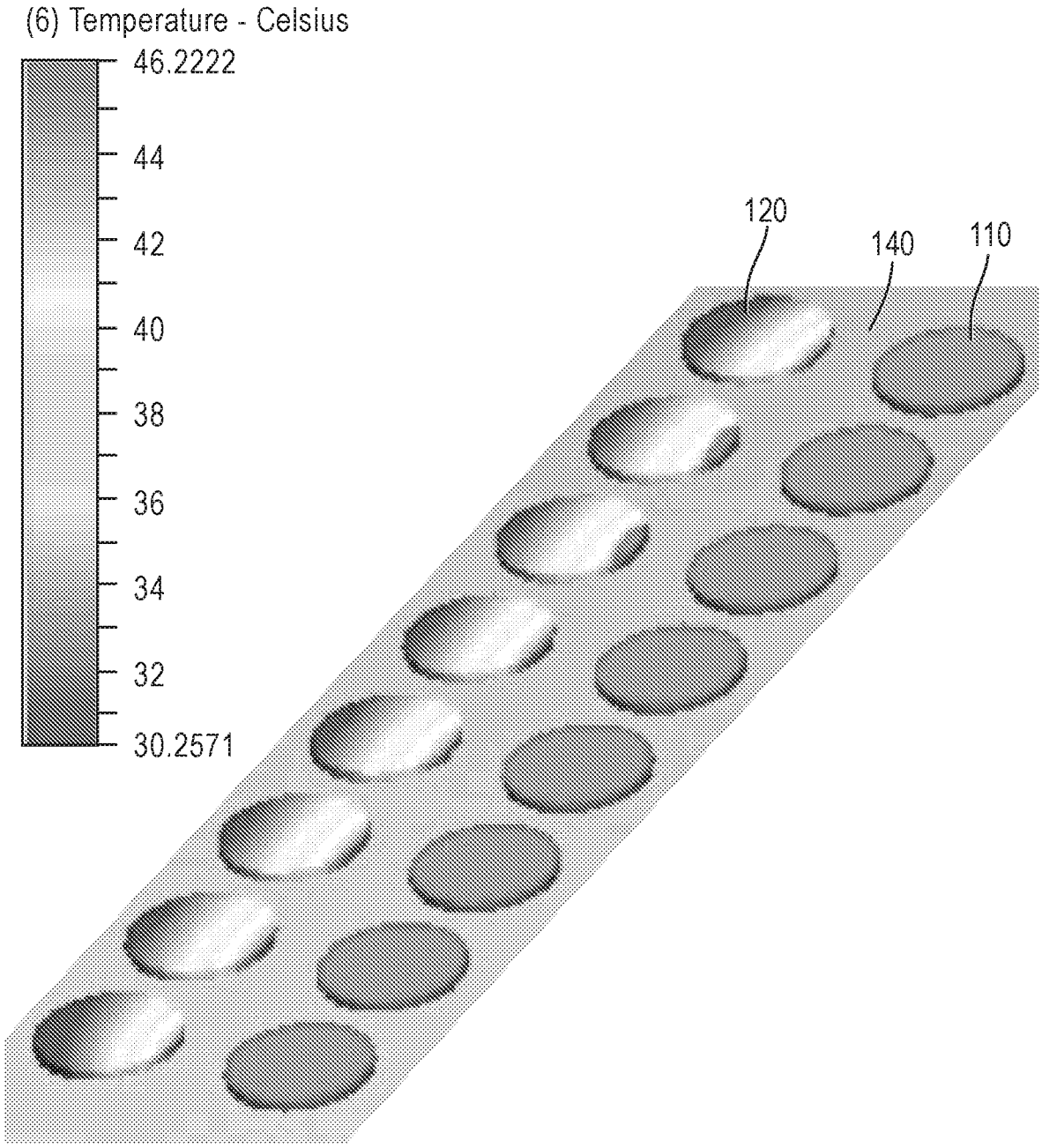
FIG. 3B is a perspective view of the effect of a heated row of reaction sites on an adjacent row.

Thermal block 150 was set to 95° C. and the results are depicted in FIG. 3A. FIG. 3A clearly shows the individual reaction sites that were not visible in FIG. 2A. The addition of pedestals to thermal block 150 demonstrates more localized heating of the reaction sites of row 110 without dramatically affecting row 120. FIG. 3B provides more thermal detail of rows 110 and 120. Once again, row 110 is shown with uniform shading which indicates a uniform temperature. The temperature scale provided in FIG. 3B now indicates that the warmest region of row 120 is now approximately 46° C., and the gradient across the reaction sites is approximately 16° C. Comparing these results to the results shown in FIG. 2A indicates the addition of the pedestals to thermal block 150 reduces the absolute temperature of row 120 and the size of the thermal gradient across the reaction sites by approximately 4° C. or approximately an 8% improvement. One skilled in the art will recognize that the dimensions and geometries of the pedestals and reaction site dimensions can be modified for other applications as presented above.

Figure 5:
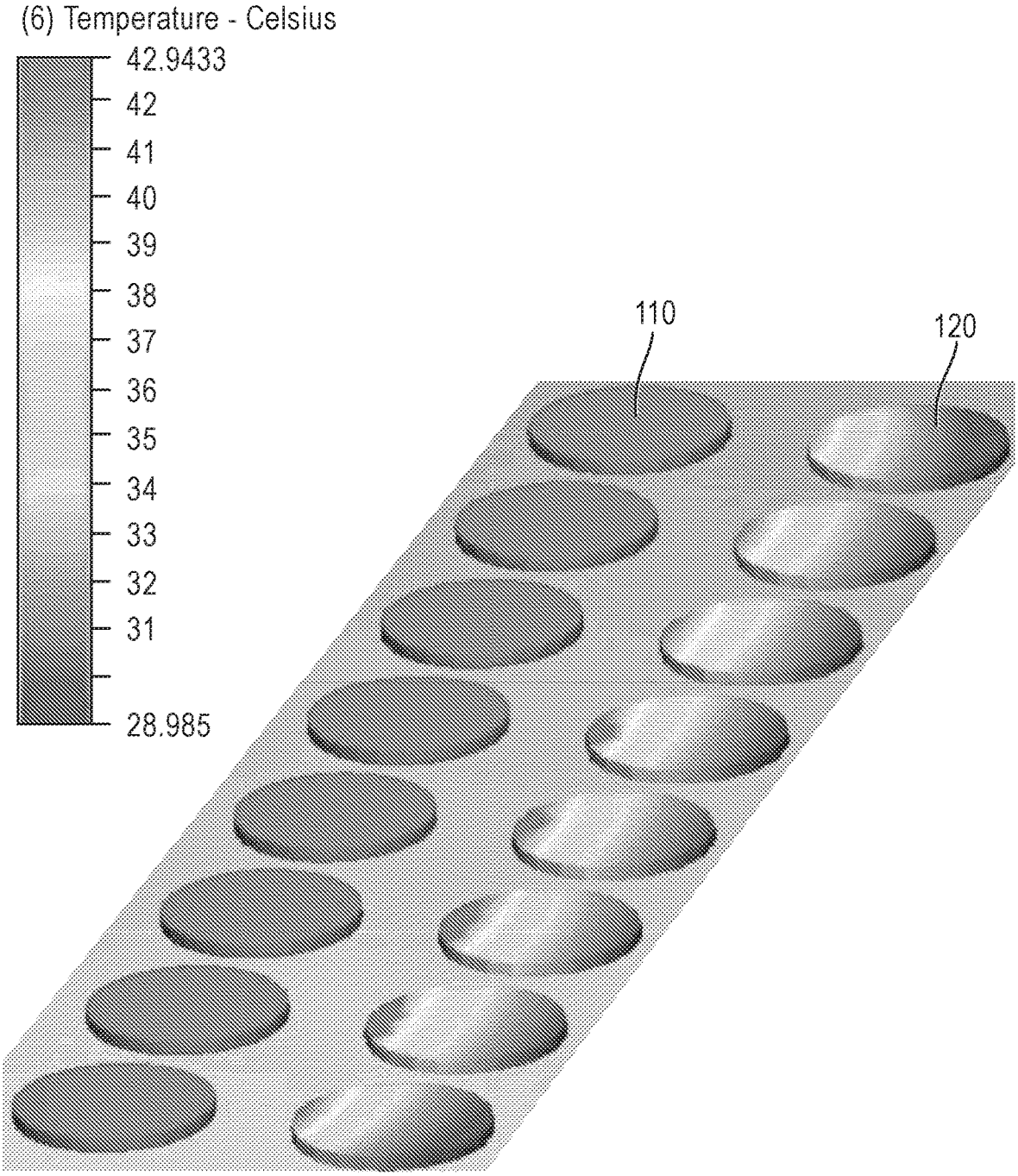
FIG. 5 is a thermal representation of a row of reaction sites heated with the heated block of FIG.

Another embodiment to improve thermal isolation between adjacent reaction sites as compared to FIG. 2A is depicted in FIG. 4. Thermal block 440 is shown with pedestals 430 and pedestal surfaces 450. In this example the shape of the pedestals is substantially circular. One skilled in the art however, would recognize that the pedestals can be any shape or size as presented above. In this case the pedestals have been modified to include a radius around an upper circumference to accommodate rings 410 and 420. Rings 410 are shown to have a smaller thickness than rings 420 and are substantially circular to match the shape of the pedestals. One skilled in the art would know that the rings can be any shape or size to match the shape of the pedestals, and therefore may not be described as rings in some embodiments. Rings 410 and 420 can also comprise a thermal insulating material to further prevent heat leak from thermal block 440 to an adjacent row. The results of heating thermal block 440 to 95° C. for 10 minutes are shown in FIG. 5. According to the scale in FIG. 5, row 120 was heated by row 110 to a maximum temperature of approximately 43° C. FIG. 5 also illustrates that the pedestals with rings 410 are warmer at the adjacent reaction sites than the pedestals with rings 420, thus establishing that modifying the geometry of the pedestals and including thermal resistive rings reduces the thermal interactions between the rows. In this embodiment, unheated row 120 reached a maximum temperature of approximately 43° C. with a thermal gradient of 14° C. which translates to an overall improvement in the temperature of row 120 of 14% as compared to the data in FIG. 2A.

Slots Between Reaction Sites

Figure 6A:
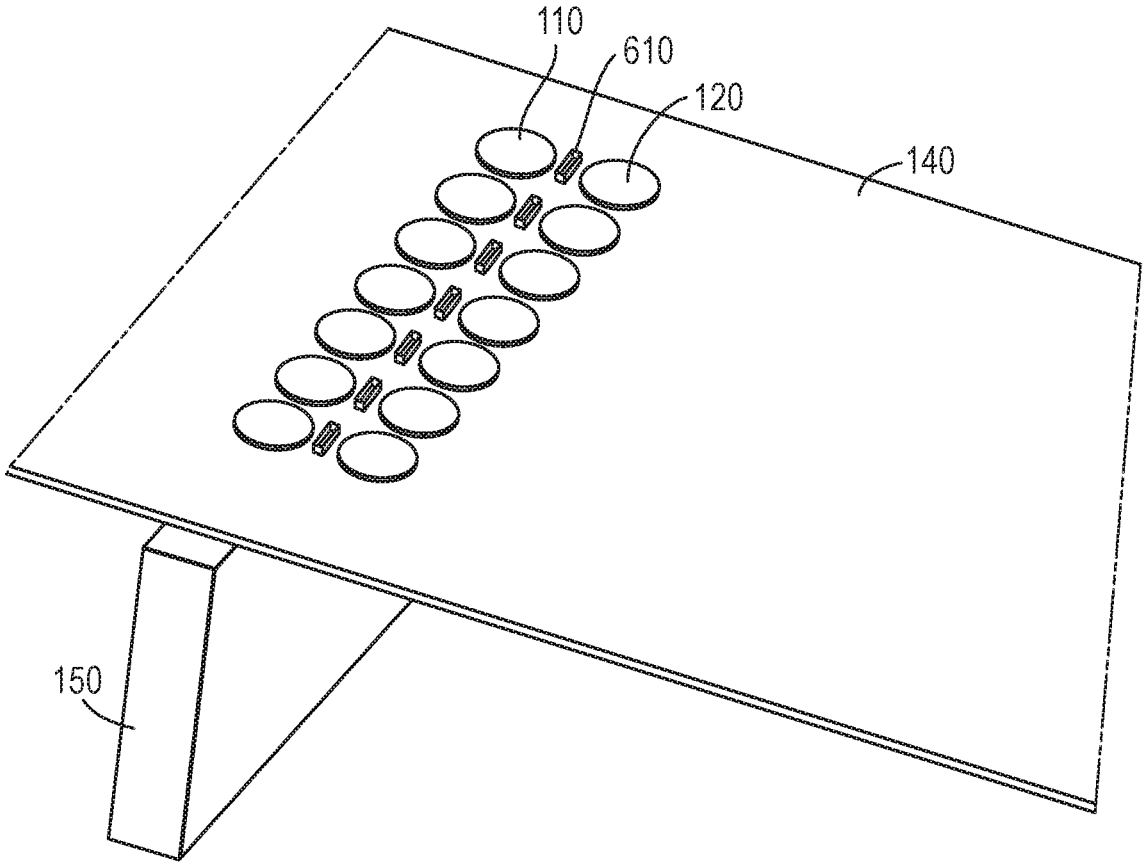
FIG. 6A is a top view of a substrate with slots inserted between two rows of reaction sites according to various embodiments.
Figure 6B:
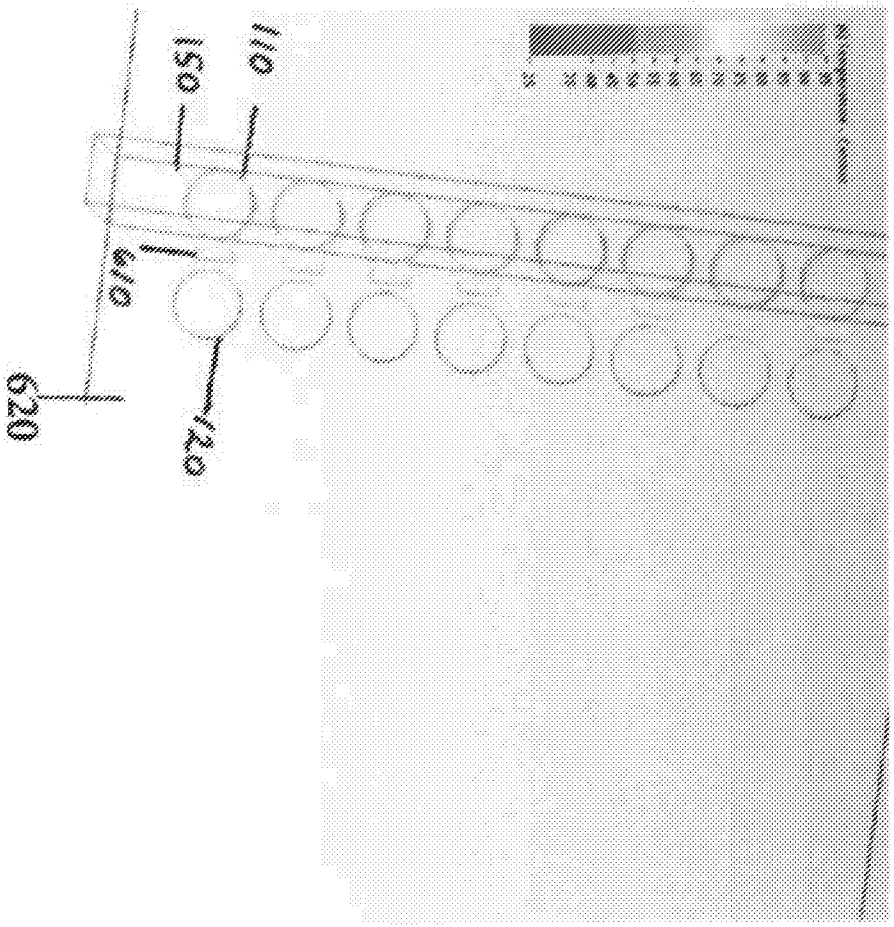
FIG. 6B is a bottom view depicting the relationship between a sample block and slots inserted between two rows of reaction sites according to various embodiments.

FIG. 6A depicts another embodiment in which slots 610 were located between rows 110 and 120. Slots 610 can introduce a thermal resistance between the rows and thereby decrease the flow of heat from a heated row to an unheated row. Factors that can affect the flow of heat in the device can include, but not be limited to, length of the gap, width of the gap and the location of the gap. FIG. 6A shows a perspective view of a portion of a substrate that includes heated block 150 located under substrate 140 and aligned opposite the reaction sites of row 110. Block 150 has the same configuration as block 150 of FIG. 4. FIG. 6A further shows slots located between each reaction site of row 110 and row 120. The distance between row 110 and row 120 is 10 mm and the dimensions of the slots is 1 mm×4 mm One skilled in the art would know that the dimensions of the slots and distance between rows, are arbitrary and selected to provide the performance required by the embodiment. In this example, the distance between rows and slot dimensions are based on the dimensions of the substrate and corresponding reaction sites as well as the density of the reaction sites.

To determine the effectiveness of this embodiment, block 150 was heated to 95° C. and held at that temperature for 10 minutes. As presented above this time/temperature combination is not uncommon in a PCR protocol and can represent a worst case scenario for heat leak to adjacent reaction sites. FIG. 6B shows thermal results and is a view of the underside of substrate 140. Block 150 is oriented such that the upper four pedestals are fitted with 0.5 mm thick rings and the lower four pedestals are fitted with 1.0 mm thick rings. Slots 610 retarded the flow of heat from row 110 to row 120 such that the maximum temperature of the upper 4 reaction sites of row 120 ranged from 36° C.-38° C., and maximum temperature of the lower 4 reaction sites ranged from 35° C.-37° C.

Figure 7A:
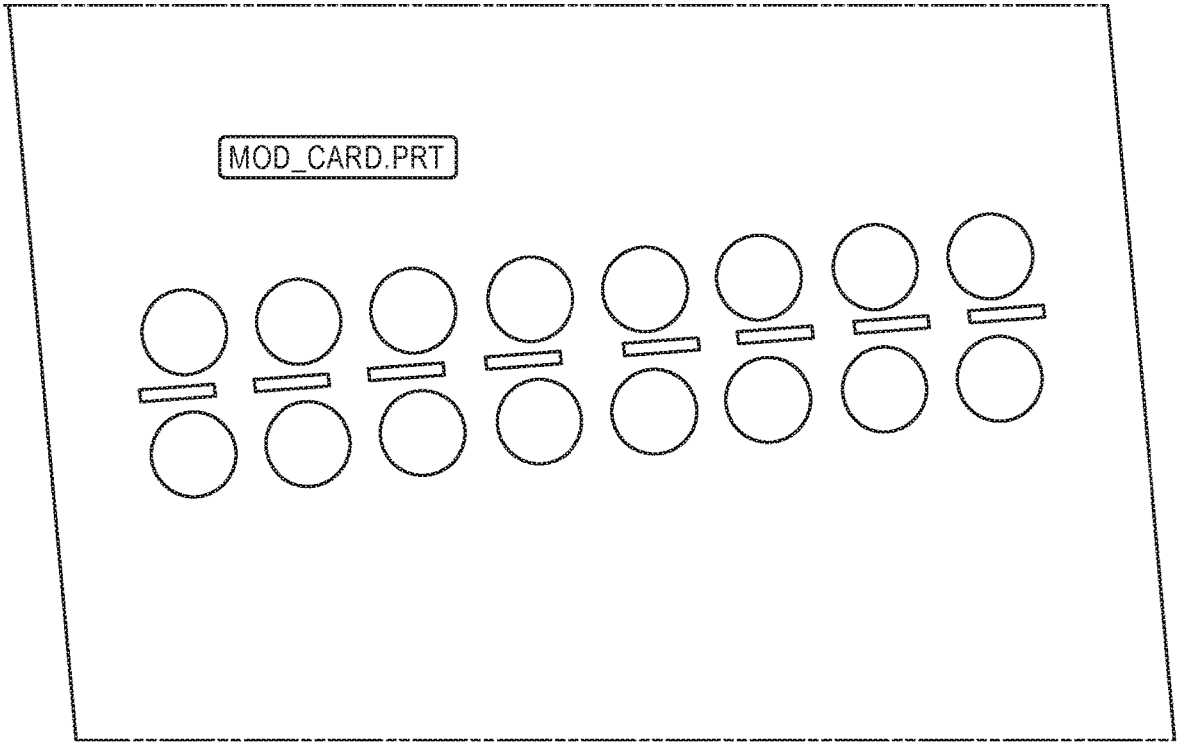
FIG. 7A is a perspective view of a substrate with slots inserted between two rows of reaction sites and shifted in relation to the reaction sites, in accordance with various embodiments.
Figure 7B:
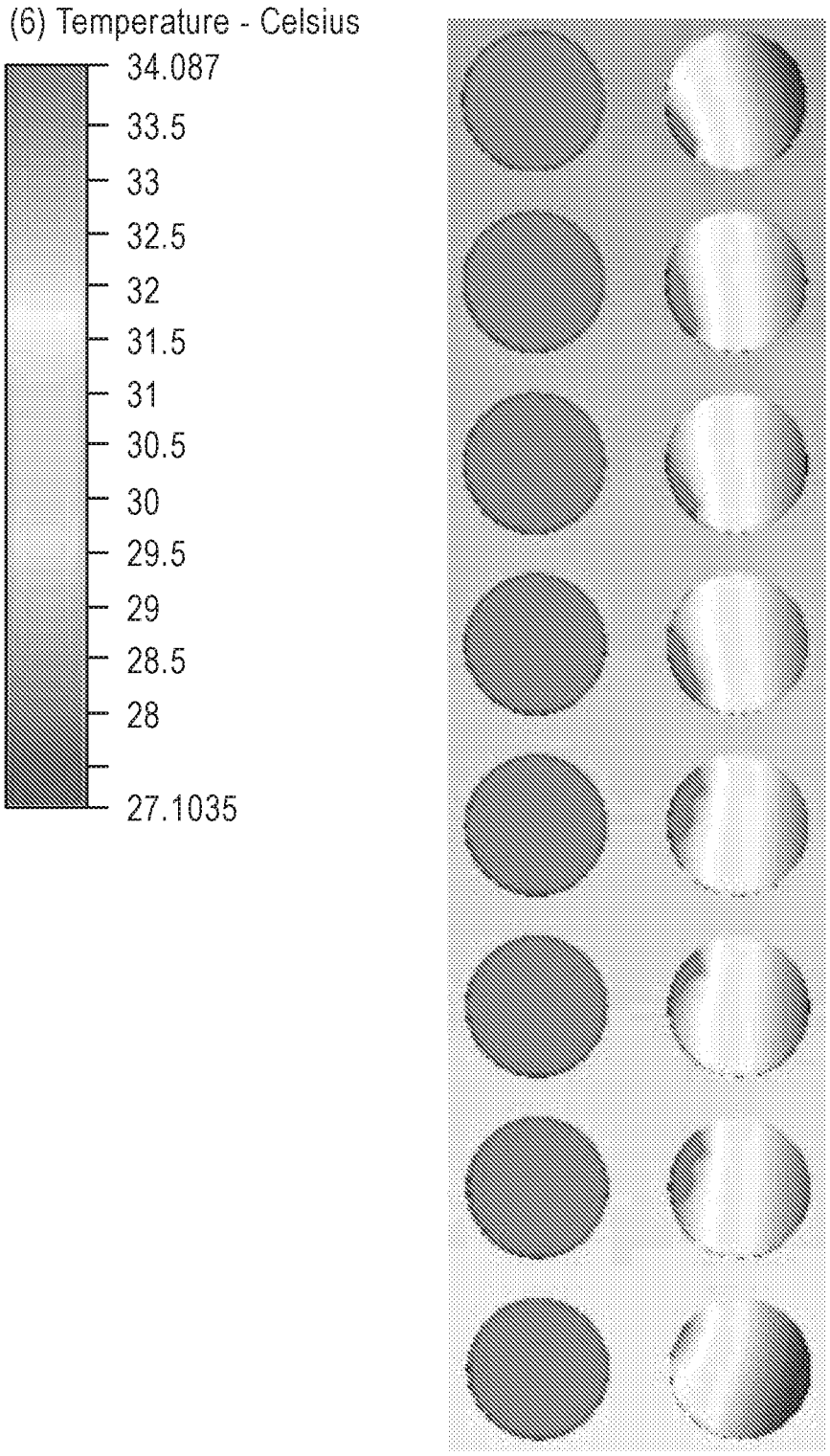
FIG. 7B is a perspective view of a thermally mapped heated row of reaction sites on an adjacent row of reaction sites with slots inserted between the rows.

The results illustrated in FIG. 6B illustrate that the use of slots between reaction sites can also be an effective way of breaking the heat flow to considerably lower the maximum temperature in the adjacent row as compared to FIG. 2A. One skilled in the art can see that further optimization of the slot is possible. One such embodiment is shown in FIG. 7A that shows slots slightly offset between the reaction sites. FIG. 7B illustrates the thermal results of heating the thermal block to 95° C. and maintaining 95° C. for 10 minutes. As indicated by the temperature scale the maximum temperature of the adjacent reaction sites has dropped to approximately 34° C. This result demonstrates the effectiveness of slots to improve thermal isolation between reaction sites as compared to FIG. 2A Row Spacing Vs. Ambient According to another embodiment thermal isolation can be improved over FIG. 1 by varying the distance between the rows of reaction sites.

Figure 8:
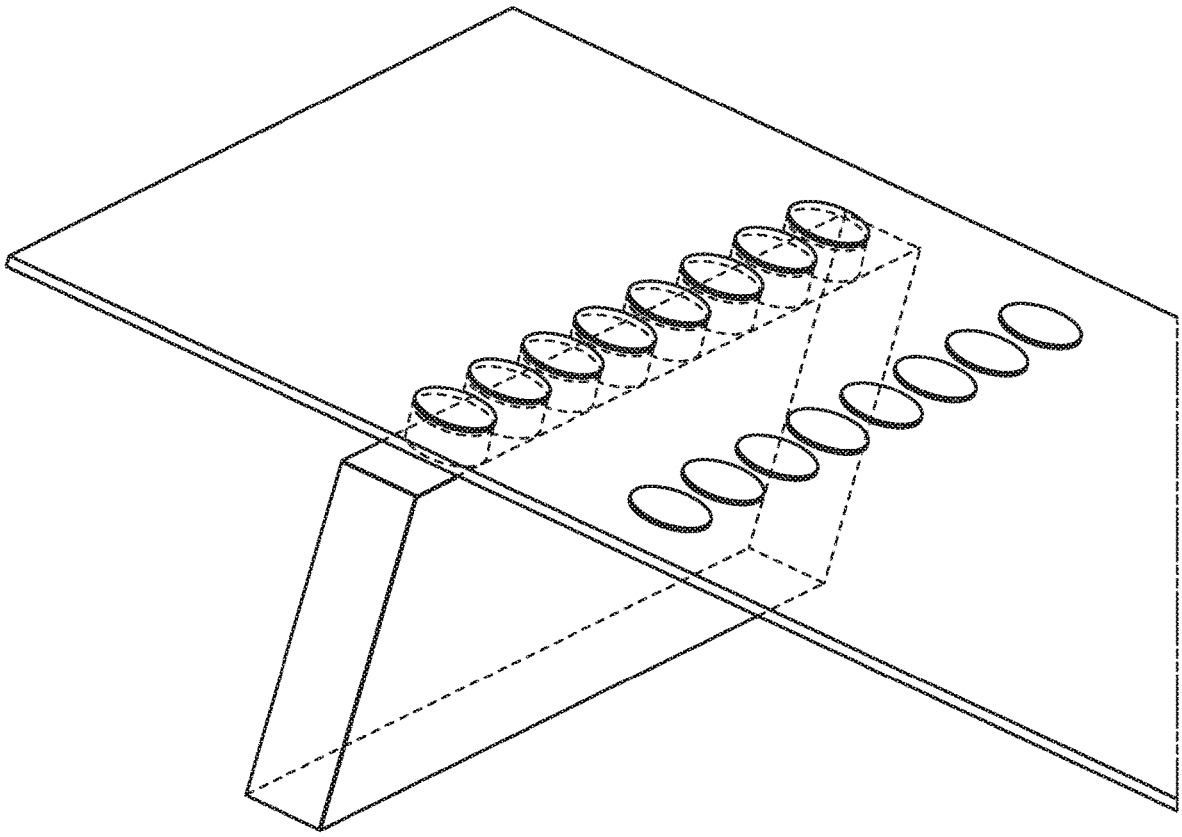
FIG. 8 is a perspective view of a substrate with increased spacing between the rows, in accordance with various embodiments.
Figure 9A:
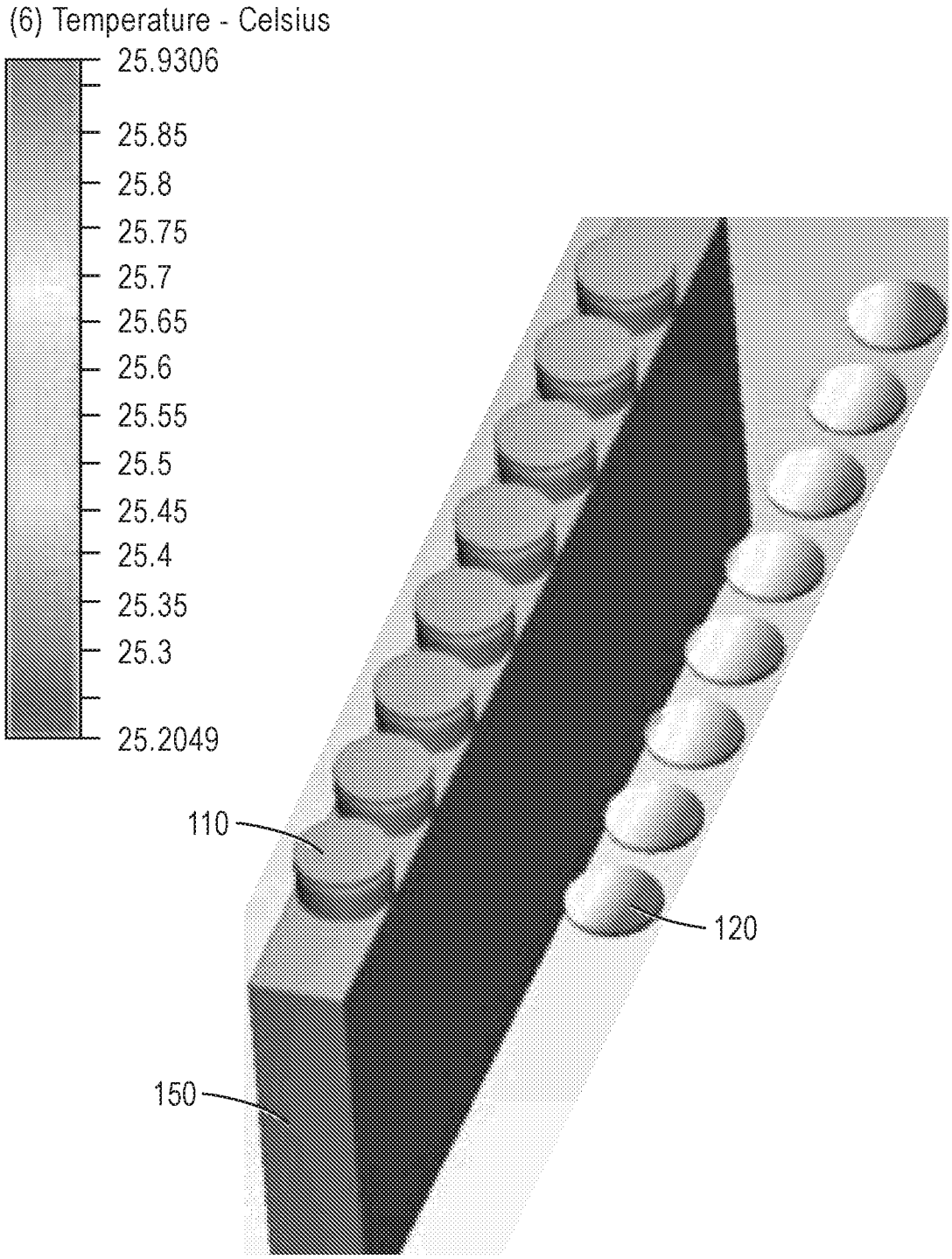
FIG. 9A is a perspective view of a thermally mapped heated row of reaction sites on an adjacent row of reaction sites.
Figure 9B:
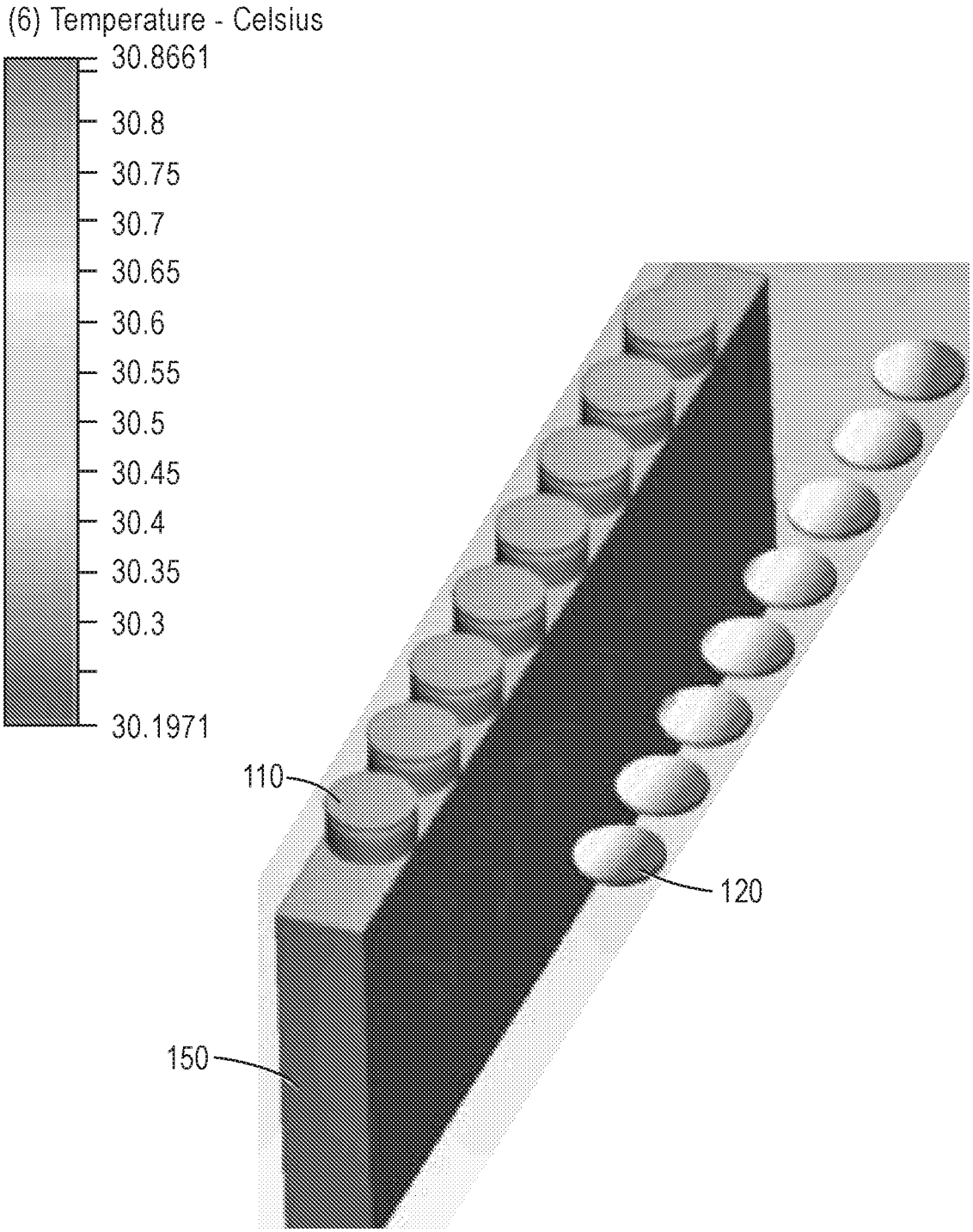
FIG. 9B is another perspective view of a thermally mapped heated row of reaction sites on an adjacent row of reaction sites.
Figure 10A:
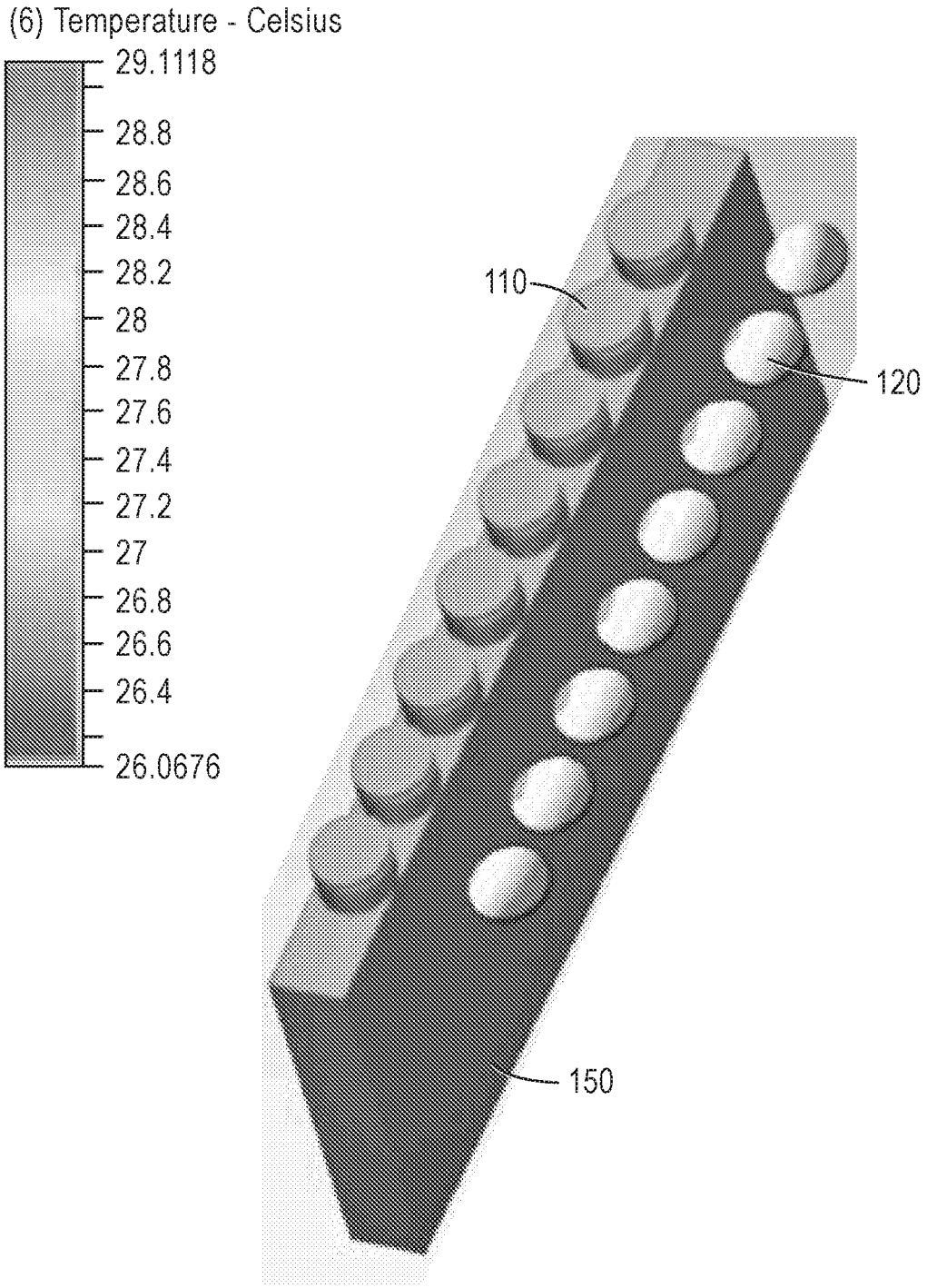
FIG. 10A is another perspective view of a thermally mapped heated row of reaction sites on an adjacent row of reaction sites, in accordance with various embodiments.
Figure 10B:
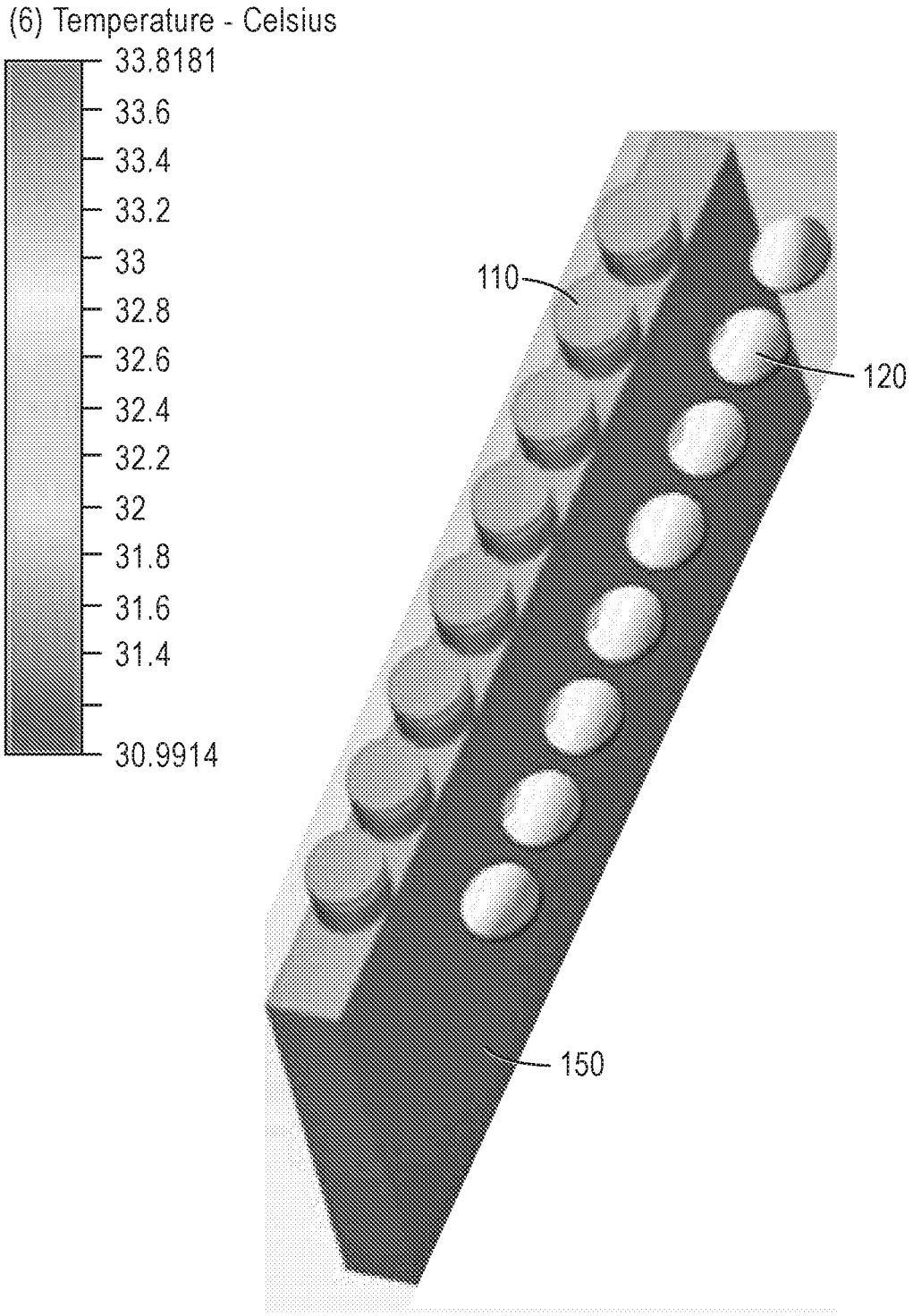
FIG. 10B is another perspective view of a thermally mapped heated row of reaction sites on an adjacent row of reaction sites.

FIG. 8 shows the spacing increased from the spacing presented above in FIG. 1. After heated block 150 is heated to 95° C. and held at 95° C. for 10 minutes at an ambient temperature of 25° C., FIG. 9A shows a thermal map representing the results after the 10 minute hold time. Referring to the scale in FIG. 9A the temperature of adjacent row 120 achieves a maximum temperature of approximately 26° C. This maximum temperature is a significant improvement in isolation when compared to the spacing shown in FIG. 1. In FIG. 9B the effect of an increase in ambient to 30° C. is shown. Referring to the temperature scale the increase in ambient of 5° C. results in approximately 4° C. increase in row 120. FIG. 10A shows similar results for a row spacing of 15 mm at 25° C. ambient conditions, and FIG. 10B shows the results for the same 15 mm simulation at 30° C. ambient. This data demonstrates that increasing the spacing between the reaction sites and reducing the ambient temperature can result in improved thermal isolation between reaction sites as compared to FIG. 2A. One skilled in the art will realize that the chosen row spacing can be dependent on the geometry of the substrate as well as the reaction site density.

Cooling Blocks

Figure 11:
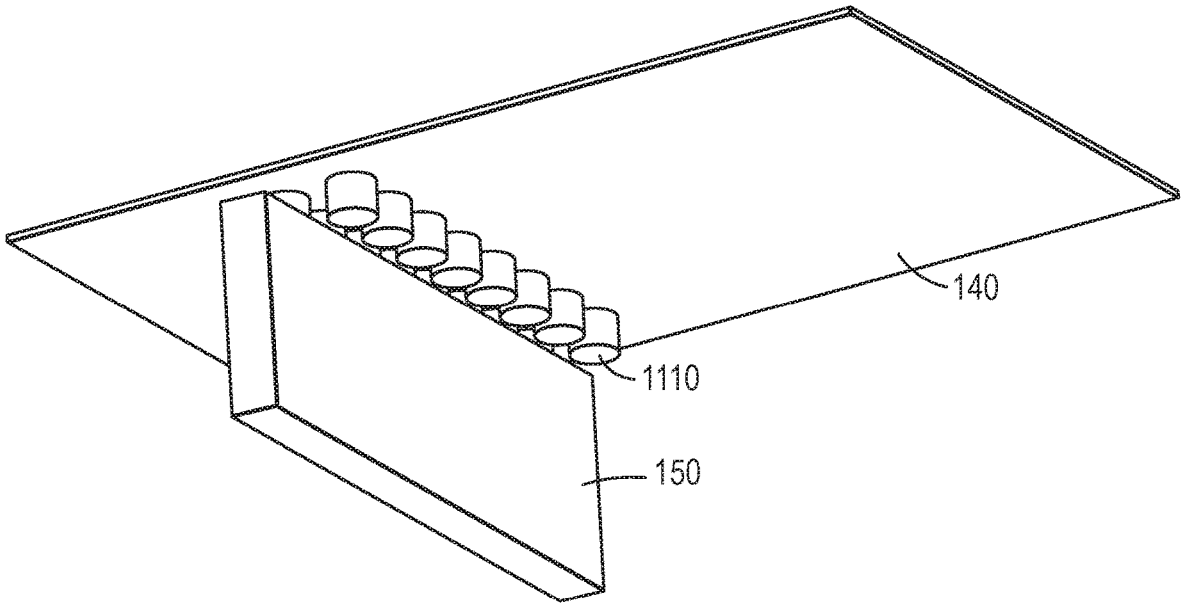
FIG. 11 is a perspective view of a thermal block with the addition of cooling blocks under the adjacent reaction sites, in accordance with various embodiments.

In yet another embodiment the adjacent row presented above can be cooled. FIG. 11 depicts an embodiment of the underside of substrate 140. Heated block 150 is also shown located opposite the reaction sites of row 110, as presented previously, and cooling blocks 1110 are shown opposite the reaction sites of row 120 with one cooling block aligned with each reaction site.

In one embodiment, cooling blocks 1110 can be used to provide greater thermal mass to adjacent row 120 in much the same way that a heat sink can be used to remove heat from a hot object to ambient. As such, it would be advantageous for the cooling blocks to comprise a thermally conductive material such as, for example aluminum and copper. One skilled in the art can appreciate that the effectiveness of the cooling blocks in this embodiment can also be dependent, for example, on the size of cooling blocks 1110 relative to the size of the reaction sites.

Figure 12:
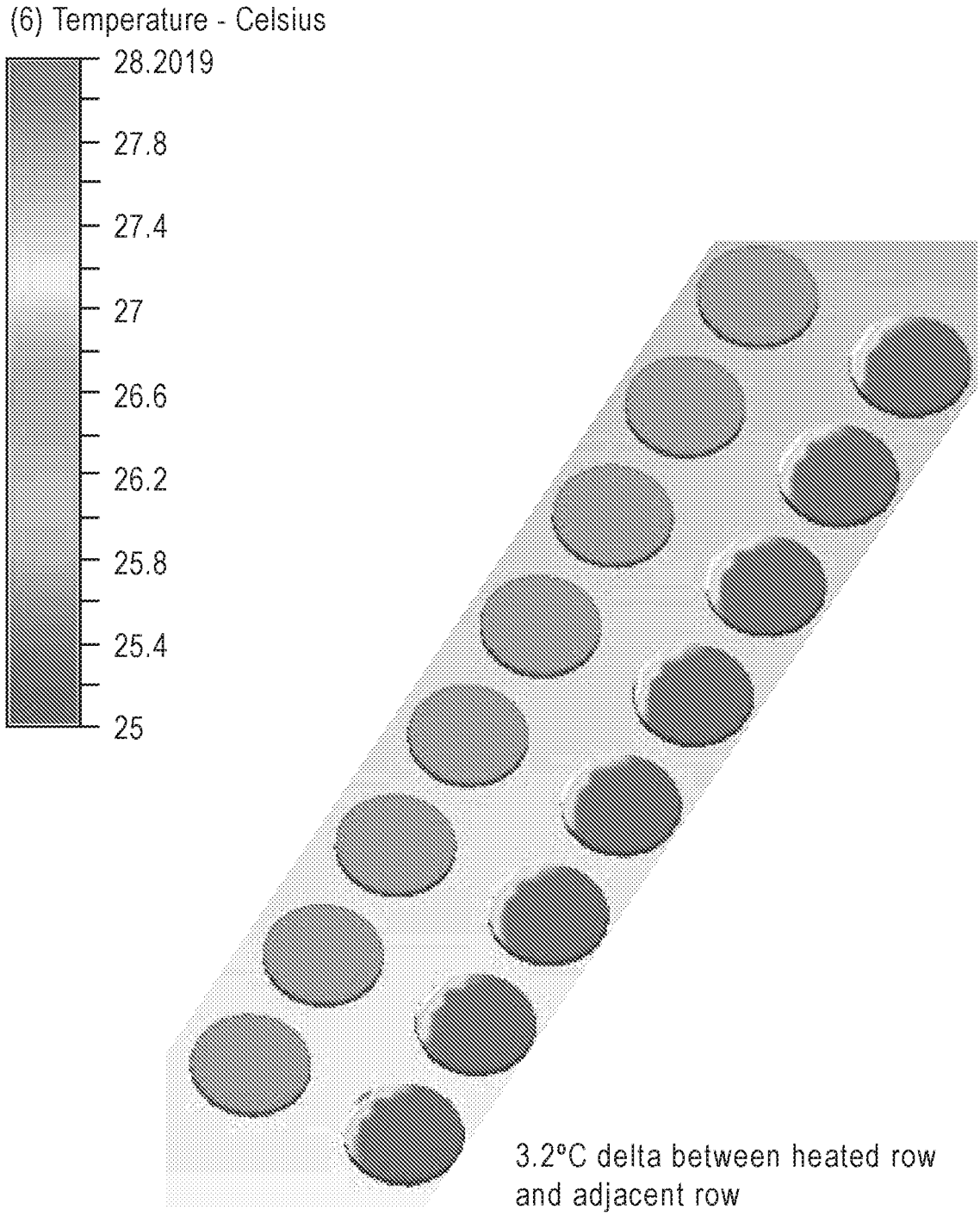
FIG. 12 is a perspective view of a thermally mapped heated row of reaction sites on an adjacent row of reaction sites.

An alternative embodiment can provide active cooling to cooling blocks 1110. Active cooling can be provided by any number of implementations known in the art. For example various implementations of active cooling can include, but not be limited to, thermoelectric cooling, chilled fluid pumped through the cooling blocks and heat pipes. The thermal results of an active cooling solution are shown in FIG. 12. Heated block 150 was heated to 95° C. and held at 95° C. for 10 minutes and cooling blocks 1110 were cooled and held at 25° C. after which the thermal map of FIG. 12 was captured. As can be seen on the temperature scale the warmest edges of row 120 are maintained at approximately 28° C. which is approximately one half of the maximum temperature of row 120 in FIG. 2A. It can also be seen in FIG. 12 that the thermal gradient across adjacent row 120 has been significantly reduced as compared to the thermal map of FIG. 2A further demonstrating the effectiveness of cooling blocks 610 in thermally isolating the reaction sites.

While the principles of this invention have been described in connection with various embodiments of a thermal block and substrate, it should be understood clearly that these descriptions are made only by way of example and are not intended to limit the scope of the invention. What has been disclosed herein has been provided for the purposes of illustration and description. It is not intended to be exhaustive or to limit what is disclosed to the precise forms described. Many modifications and variations will be apparent to the practitioner skilled in the art. What is disclosed was chosen and described in order to best explain the principles and practical application of the disclosed embodiments of the art described, thereby enabling others skilled in the art to understand the various embodiments and various modifications that are suited to the particular use contemplated. It is intended that the scope of what is disclosed be defined by the following claims and their equivalence.

What is claimed is:

1. A thermal block assembly comprising:

a substrate comprising a substrate surface configured with a plurality of reaction sites each reaction site configured to contain a biological sample;

a sample block; and a thermal isolation feature configured to restrict heat flow from one reaction site to another wherein the thermal isolation feature comprises pedestals provided on the sample block, and a top of each pedestal comprises a flat pedestal surface wherein each pedestal surface is proximate to the substrate surface, and wherein each pedestal comprises an individual ring fitted in a radius around the pedestal surface and each ring is composed of a material that is thermally insulating.

2. The block assembly of claim 1, wherein the thermal isolation feature further comprises a feature selected from the group consisting of slots, cooling blocks, reaction site spacing and combinations thereof.

3. The block assembly of claim 1, wherein the flat pedestal surfaces and the reaction sites have substantially the same shape, wherein the shape is selected from the group consisting of circles, ovals, rectangles and squares.

4. The block assembly of claim 3, wherein each flat pedestal surface and reaction site are substantially circular.

5. The block assembly of claim 1, wherein each pedestal surface has a dimension that is substantially equal to a dimension of the reaction site.

6. The block assembly of claim 2, wherein the thermal isolation feature further comprises cooling blocks, each cooling block located proximate to one of the reaction sites, and wherein the cooling blocks are composed of a material that is thermally conductive.

7. The block assembly of claim 6, wherein the cooling blocks are passively cooled.

8. The block assembly of claim 6, wherein the cooling blocks are actively cooled.

9. The block assembly of claim 2, wherein the thermal isolation feature further comprises slots, wherein the slots are provided in the substrate between reaction sites and extend through the substrate.

10. The block assembly of claim 9, wherein the slots are rectangular.

11. The block assembly of claim 9, wherein the slots are curved.

12. The block assembly of claim 2, wherein the thermal isolation feature further comprises reaction site spacing.

* * * * *